United States Patent [19]

Payton

[11] 4,146,965

[45] Apr. 3, 1979

[54] DRAWING INSTRUMENT

[75] Inventor: Raymond A. Payton, Bewdley, England

[73] Assignee: Helix International Limited, West Midlands, England

[21] Appl. No.: 817,103

[22] Filed: Jul. 19, 1977

[30] Foreign Application Priority Data

Nov. 19, 1976 [GB] United Kingdom ..... 48257/76

[51] Int. Cl.[2] ..... B43L 9/02; B43L 8/20

[52] U.S. Cl. ..... 33/27 B; 33/157

[58] Field of Search ..... 33/27 B, 157, 151, 152

[56] References Cited

U.S. PATENT DOCUMENTS

| | | | |
|---|---|---|---|
| 723,041 | 3/1903 | Schwarzer | 33/157 |
| 902,257 | 10/1908 | Schoenner | 33/157 |
| 2,080,917 | 5/1937 | Hochman | 33/151 |
| 2,644,239 | 7/1953 | Bellstaedt | 33/143 G |
| 3,842,508 | 10/1974 | Gentils | 33/157 |

*Primary Examiner*—Harry N. Haroian
*Attorney, Agent, or Firm*—Neil F. Markva

[57] ABSTRACT

A drawing instrument comprises a pair of die-cast limbs pivotally connected together to form an assembly at the inner ends thereof. A bow top has an interior hole and fork limbs having inside faces embracing the assembly of the ends. A centralizing member is held between the inner ends of the pivoted die-cast limbs. The centralizing member includes an elongated pivot receiving hole and first and second keying poles. A first die-cast keying projection is integrally formed at the inner end of a first one of the pivoted die-cast limbs. A first arcuate slot is provided in the inner end of the first pivoted die-cast limb. A second die-cast keying projection is integrally formed at the inner end of the second one of the pivoted die-cast limbs. A second arcuate slot is disposed in the inner end of the second pivoted die-cast limb. The first and second die-cast keying projections engage the second and first arcuate slots, respectively. The first and second die-cast keying projections engage the first and second keying holes in the centralizing member to key the centralizing member to the inner ends of the pivoted die-cast limbs. The centralizing member has a structural configuration to project up into the interior hole of the bow top and is further effective to press against a side wall of the interior hole when there is angular movement of one of the pivoted limbs with respect to the other pivoted limb. Consequently, the structural configuration of the centralizing member causes the bow top to turn and keep central. Stop means engageable with the inner ends of the pivoted limbs are effective to act against the angular opening out movement of the pivotal limbs beyond a predetermined angular limit. Thus, the two die-cast projections cannot bear against the ends of the respective arcuate recesses or slots before the stop means on the bow top bear against the inner ends of the die-cast limbs.

9 Claims, 8 Drawing Figures

II
VII
VIII
1
1a
2
3
4
5
5a
6
7
8'
9
10
11
12
13
14
15
16
17
17'
18
19
20
21
22
23
24
25
26
27
28

DRAWING INSTRUMENT

BACKGROUND OF THE INVENTION

This invention relates to drawing instruments in the form of drawing compasses or dividers, of that kind (hereinafter called "the kind referred to") having a leg and an arm, or two legs, pivoted together at inner ends thereof. The instruments also include a bow top having fork limbs embracing the assembly of pivoted ends of the leg and arm or of the two legs. A centralizing member is held between, and keyed by keying means to the pivoted-together inner ends of the leg and arm, or of the two legs. The centralizing member projects into an interior aperture or recess in the bow top whereby angular movement of the leg, or of the one leg, relatively to the arm or to the second leg, causes the centralizing member to press against a side wall of said interior aperture or recess to cause the bow top to turn and keep central.

We have previously proposed a drawing instrument which is of the aforesaid construction and includes keying means for keying the centralizing member. The keying means comprise two die-cast keying projections. One of the keying projections is located at the inner end of the leg with a first arcuate recess or aperture. The second die-cast keying projection is located at the inner end of the arm with a second arcuate recess or aperture. The first keying projection engages said second arcuate recess or aperture, and the second keying projection engages said first arcuate recess or aperture. The two die-cast keying projections act as stops engageable with the ends of the respective arcuate recesses. Such construction is robust, but if the instrument is misued by applying excessive opening-out force, there is a possibility that such excessive force might cause shearing of the die-cast projections. Thus, the centralizing plate would become inoperative, as it would no longer be keyed in place.

SUMMARY OF THE INVENTION

The object of the present invention is to provide a drawing instrument, of the kind referred to, which is of a construction which may be inexpensively made as a mass-produced article and has means whereby the possibility of the keying means, for keying the centralizing member, shearing, in the event of excessive opening-out force being applied to the instrument, is reduced or obviated.

According to the invention, a drawing instrument of the kind referred to has a bow top composed of plastics material and has stop means engageable with the inner ends of the leg and the arm, or of the two legs. The stop means act against angular opening-out movement of the leg, or the one leg, relatively to the arm or the other leg, beyond a predetermined angular limit. The stop means are effective to take at least part of the shock or strain resulting from said opening-out to the angular limit if the instrument is opened out to the predetermined angular limit.

In an exemplary embodiment of the invention, the keying means for keying the centralizing member comprise two die-cast keying projections. A first one of said die-cast keying projections is disposed at the inner end of the leg, or the one leg, with a first arcuate recess or aperture. The second die-cast keying projection is disposed at the inner end of the arm or second leg, with a second arcuate recess or aperture. The first keying projection engages said second arcuate recess or aperture, and said second keying projection engages said first arcuate recess or aperture. The stop means on the bow top being so located that, on opening out the instrument, the two die-cast projections cannot bear against the ends of the respective arcuate recesses or apertures before the said stop means on the bow top bear against the inner ends of the leg and arm, or of the two legs.

The bow top has shoulders or projections which are integrally formed on the inside faces of the fork limbs of the bow top. The shoulders have oblique lower faces which constitute the stop means on the bow top. The oblique faces are engageable with straight edge portions of the inner ends of the leg and arm, or of the two legs.

BRIEF DESCRIPTION OF DRAWINGS

In the accompanying drawings, which show, by way of example, a drawing compass constructed in accordance with the invention:

(FIGS. 3 and 4 are on a larger scale than the other Figures);

DESCRIPTION OF SPECIFIC EMBODIMENTS

Figures 1, 2, 3, 4, 5, 6, 7, 8:
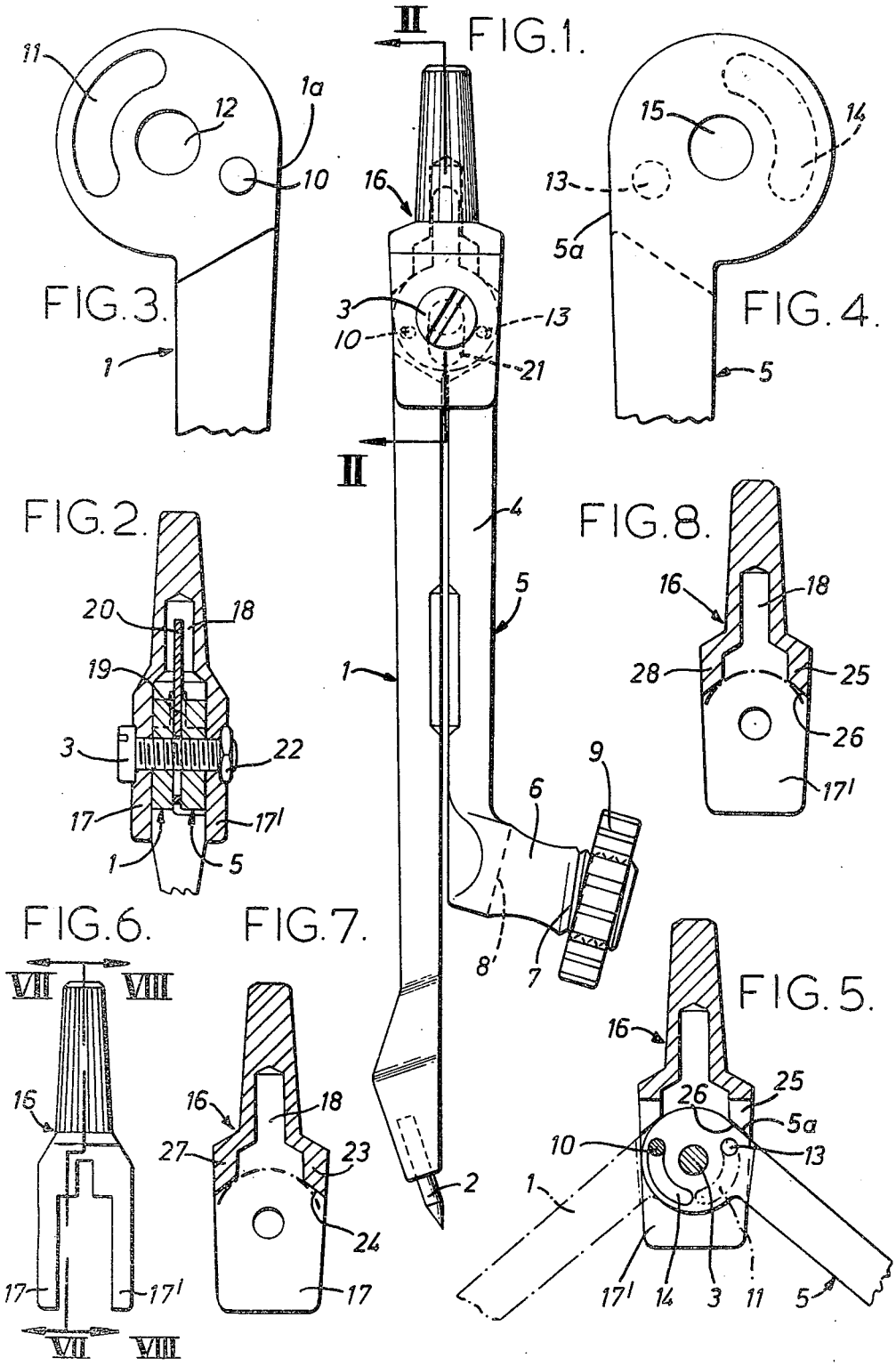
FIG. 1 is a front elevational view of a compass.
FIG. 2 is a sectional view along line II—II, FIG. 1.
FIG. 3 is an inside face view of the upper portion of a leg of the compass shown in FIG. 1.
FIG. 4 is an outside face view of the upper portion of an arm of the compass shown in FIG. 1
FIG. 5 is a fragmentary view showing the leg and the arm, of the compass shown in FIG. 1, opened out angularly relatively to each other to a predetermined angular limit position.
FIG. 6 is a side elevational view of a bow top of the compass shown in FIG. 1.
FIGS. 7 and 8 are sectional views on the lines VII—VII, FIG. 6, and VIII—VIII, FIG. 6, respectively.

Referring to the drawings, a drawing compass comprises a die-cast metal leg 1 having a pointed element 2 at its one end. Pivot screw 3 pivotally connects leg 1 at its other or inner end to one end of a shank 4 of a die-cast arm 5. Shank 4 has at its other or outer end an integral laterally-projecting stub or barrel 6 which has an external screw thread 7 thereon. Barrel 6 is formed with a socket hole 8 for receiving a pencil or the like. An internally screw-threaded knurled clamping ring 9 is mounted on the stub or barrel 6 and is operatively engaged with the external screw thread. Ring 9 clamps the pencil or the like in place in the socket hole 8 in the stub or barrel 6.

The leg 1 of the compass shown has an integral die-cast projection, an arcuate recess 11, and a plain hole 12 for the pivot screw 3 at its pivoted end. Projection 10, recess 11 and hole 12 are formed in the die-casting of the said leg 1. The arm 5 has an integral die-cast projection 13 identical with the projection 10, an arcuate recess 14 identical with the recess 11, and a plain hole 15 for engagement by the pivot screw 3. Projection 13, recess 14 and hole 15 are also formed during the die-casting of arm 5. The projection 10 engages into the recess 14 and the projection 13 engages into the recess 11.

The compass shown has a bow top 16 composed of nylon and having integral fork limbs 17, 17$^1$ which embrace the assembly of pivoted ends of the leg 1 and arm 5. Bow top 16 is held in place by pivot screw 3 which engages holes in the fork limbs 17, 17$^1$. The bow top 16 has an interior recess 18 having a mouth presented towards the pivoted-together ends of the leg 1 and arm 5.

A steel centralizing plate 19 is mounted on pivot screw 3 and held between said pivoted-together ends of the leg 1 and arm 5. Plate 19 has a pair of elongate keying holes (shown in dotted lines in FIG. 1) which are respectively engaged one with each of the projections 10 and 13. Thus, plate 19 is keyed to said pivoted-together ends of the leg 1 and arm 5. The plate 19 has an integral upper tongue or projection portion 20 which projects into the interior recess 18 in the bow top 16. Thus, angular movement of one of the members 1 and 5 relatively to the other of said members 1 and 5, causes the tongue portion 20 of the centralizing plate 19 to press against a wall of recess 18 to cause bow top 16 to turn about the axis of the screw 3 to thereby keep central with respect to the parts 1 and 5. The screw 3 passes through a hole 21 in centralizing plate 19. Hole 21 is elongated to permit plate 19 to move transversely to the pivot screw 3 when turning about said screw 3. Nut 22 holds screw 3 adjacent the outer face of one of the fork limbs of bow top 16.

A shoulder or projection 23 is integrally formed on the inside face of the one fork limb 17 of the nylon bow top 16. Projection 23 has an oblique lower face constituting a stop surface 24 engageable with a straight edge portion $1^a$ of the leg 1. A shoulder or projection 25 is also integrally formed on the inside face of the other fork limb 17' of the bow top 16. Projection 25 is at the opposite side of the pivotal axis of pivot 3 with respect to the identical projection 23. Projection 25 has an oblique lower face constituting a stop surface 26 engageable with a straight edge portion $5^a$ of the arm 5.

When leg 1 and arm 5 are opened out angularly with respect to each other as shown in FIG. 5, the stop surfaces 24 and 26, respectively, engage the edges $1^a$ and $5^a$ and act against angular opening-out movement of the leg 1 and arm 5 beyond a predetermined angular limit position. The stop surfaces 24 and 26 are so located, in the example shown, that the two die-cast projections 10 and 13 cannot bear against the ends of the respective arcuate recess 14 and 11 before stop surfaces 24 and 26 bear against the edges $1^a$ and $5^a$. Consequently, at least part of the shock or strain resulting from such opening out to the limit is taken by the stop surfaces 24 and 26. Thus, the possibility of opening out with excessive force causing shearing of the die-cast projections 10 and 13 is considerably reduced or is obviated.

The compass shown is of a neat and robust construction which can be inexpensively manufactured by mass production.

In the arrangement shown, each fork limb 17 or $17^1$ has a further integral shoulder or projection 27 or 28, identical to the shoulders or projections 23 and 25. The downwardly presented oblique surfaces of said further shoulders or projections 27 and 28 do not act as stop surfaces for engaging the edges $1^a$ and $5^a$. That is, shoulders or projections 27 and 28 act in conjunction with shoulders or projections 23 and 25 as means for aligning the pivot holes in the leg, arm and bow top, during assembly of the compass, in a manner described in our copending U.S. application Ser. No. 817,104 filed July 19, 1977.

If desired, the centralizing plate may be keyed in place by keying means otherwise than by two die-cast projections.

The predetermined angular limit position may, if desired, be other than that shown in FIG. 5. The locations of the obliquely presented stop means are chosen accordingly.

The predetermined angular limit position may if desired be other than that shown in FIG. 5, the locations of the obliquely-presented stop means being chosen accordingly.

The material of the die-cast leg 1 and arm 5 may, for example, be a zinc-based metal alloy.

The parts of the compass shown may be of any other material, but it is preferred that the leg 1 and arm 5 be of die-cast material and that the bow top be of plastics material.

The invention is also applicable to dividers. Dividers constructed in accordance with the invention may, for example, be of a construction similar to that shown in the drawings except that a second leg, similar to the leg 1, takes the place of the arm 5.

I claim:

1. A drawing instrument comprising:

(a) pivot means connecting a pair of die-cast limbs together forming an assembly at the inner ends of said limbs, (b) a bow top pivoted to the pivot means and having an interior hole and fork limbs having inside faces embracing the assembly of said inner ends, (c) a centralizing member held between said inner ends of said pivoted die-cast limbs, (d) said centralizing member including an elongated pivot receiving hole and first and second keying holes, (e) said elongated hole receiving the pivot means, (f) a first die-cast keying projection integrally formed at the inner end of a first one of said pivoted die-cast limbs, (g) a first arcuate slot provided in said inner end of said first pivoted die-cast limb, (h) a second die-cast keying projection integrally formed at the inner end of the second one of said pivoted die-cast limbs, (i) a second arcuate slot provided in said inner end of said second pivoted die-cast limb, (j) said first and second die-cast keying projections engaging said first and second arcuate slots, respectively, (k) said first and second die-cast keying projections, respectively engaging said first and second keying holes in said centralizing member to key the centralizing member to said inner ends of the pivoted die-cast limbs, (l) said centralizing member having a projection portion projecting up into said interior hole in the bow top, (m) said projection portion being effective to press against a sidewall of said interior hole when there is angular movement of either pivoted die-cast limb to cause the bow top to turn and keep central, and (n) shoulders being integrally formed on said inside faces and having stop faces engageable with said inner ends of said pivoted die-cast limbs, (o) said stop faces being effective to act against angular opening out movement of the pivoted die-cast limbs with respect to each other beyond a predetermined angular limit, (p) said stop faces being effective to bear against the inner ends of the two pivoted die-cast limbs before said die-cast keying projections can bear against the ends of the respective ones of said arcuate slots when the instrument is opened.

2. A drawing instrument as defined in claim 1 wherein said bow top is composed of plastics material, said stop faces comprise oblique lower faces on said shoulders, and the inner ends of the two pivoted die-cast limbs have straight edge portions with which said stop faces are engageable when the instrument is opened out.

3. A drawing instrument comprising:

(a) means pivotally connecting a pair of die-cast limbs together forming an assembly at the inner ends thereof, (b) a bow top pivoted to said pivotally connecting means having an interior hole and fork limbs embracing the assembly, (c) said limbs including die-cast means for keying a centralizing member held between the pivotally connected inner ends of said die-cast limbs, (d) said centralizing member having a structural configuration effective to project up into said interior hole, (e) said structural configuration being further effective to press against a sidewall of said interior hole when there is angular movement of one of the pivoted limbs to cause the bow top to turn and keep central, (f) said bow top including stop means engageable with said inner ends of the pivoted limbs, (g) said stop means being effective to act against angular opening-out movement of the one pivoted limb with respect to the other pivoted limb beyond a predetermined angular limit, (h) said stop means being effective to take at least part of the shock or strain resulting from said opening out to the limit instead of said keying means taking said shock if the instrument is opened out to said predetermined angular limit.

4. A drawing instrument as defined in claim 3 wherein the bow top includes shoulders integrally formed on said inside faces of the fork limbs of the bow top, said shoulders having oblique lower faces which constitute said stop means, said oblique faces being engageable with straight edge portions of the inner ends of the two pivoted limbs.

5. A drawing instrument as defined in claim 3 wherein the die-cast keying means comprise two die-cast keying projections, a first one of the die-cast keying projections being disposed at the inner end of one pivoted limb with a first arcuate slot, the second die-cast keying projection being disposed at the inner end of the other pivoted limb with a second arcuate slot, said first and second keying projections engaging said second and first arcuate slots, respectively, said centralizing member including first and second keying holes for receiving said first and second keying projections, and the stop means on the bow top being so located that the two die-cast projections cannot bear against the ends of the respective arcuate slots before said stop means on the bow top bear against the inner ends of the two pivoted limbs.

6. A drawing instrument as defined in claim 5 wherein the bow top is composed of plastics material.

7. A drawing instrument as defined in claim 5 wherein the bow top includes shoulders integrally formed on said inside faces of the fork limbs of the bow top, said shoulders having oblique lower faces which constitute said stop means, said oblique faces being engageable with straight edge portions of the inner ends of the two pivoted limbs.

8. A drawing instrument as defined in claim 3 wherein the structural configuration of said centralizing member has a projection portion for projecting up into said interior hole and an opening to surround said pivot means.

9. A drawing instrument as defined in claim 8 wherein said opening in the centralizing member is elongated.

* * * * *